US005373655A

United States Patent [19]

Suzuki

[11] Patent Number: 5,373,655

[45] Date of Patent: Dec. 20, 1994

[54] APPARATUS FOR MOUNTING ADVERTISEMENT NOTICE

[75] Inventor: Teruo Suzuki, Chiba, Japan

[73] Assignee: SCS Promotion Company Limited, Chiba, Japan

[21] Appl. No.: 22,845

[22] Filed: Feb. 25, 1993

Related U.S. Application Data

[62] Division of Ser. No. 768,221, Oct. 15, 1991, Pat. No. 5,373,653.

[30] Foreign Application Priority Data

Mar. 20, 1990 [JP] Japan ..... 2-71540

[51] Int. Cl.[5] ..... G09F 21/04

[52] U.S. Cl. ..... 40/603; 40/590

[58] Field of Search ..... 40/590, 591, 603, 604, 40/589; 160/327, 328, 378

[56] References Cited

U.S. PATENT DOCUMENTS

| | | | |
|---|---|---|---|
| 2,338,297 | 1/1944 | Mugdan et al. . | |
| 2,391,871 | 1/1946 | Benson . | |
| 2,527,258 | 10/1950 | Kahn . | |
| 2,647,261 | 8/1953 | Rassner . | |
| 2,764,830 | 10/1956 | Frey | 40/604 |
| 3,276,512 | 10/1966 | Gallagher . | |
| 3,461,584 | 8/1969 | Wilson . | |
| 3,609,894 | 10/1971 | Miller III | 40/604 |
| 3,701,210 | 10/1972 | Smith . | |
| 3,831,304 | 8/1974 | Miller et al. | 40/604 |
| 3,995,715 | 12/1976 | Virtanen . | |
| 4,369,591 | 1/1983 | Vicino . | |
| 4,776,121 | 10/1988 | Vicino . | |
| 4,800,947 | 1/1989 | Loomis . | |
| 4,875,302 | 10/1989 | Noffsinger . | |
| 4,894,888 | 1/1990 | Bassouls . | |

FOREIGN PATENT DOCUMENTS

| | | |
|---|---|---|
| 256293 | 2/1964 | Australia . |
| 36221/68 | 3/1970 | Australia . |
| 88485/82 | 3/1983 | Australia . |
| 1165/88 | 8/1988 | Australia . |
| 12339/88 | 9/1988 | Australia . |
| 0078391A1 | 5/1983 | European Pat. Off. . |
| 0132495 | 2/1985 | European Pat. Off. . |
| 0136400 | 4/1985 | European Pat. Off. . |
| 0294301 | 12/1988 | European Pat. Off. . |
| 296863 | 12/1988 | European Pat. Off. . |
| 382478 | 8/1990 | European Pat. Off. . |
| 0389104 | 9/1990 | European Pat. Off. . |
| 2255448 | 7/1975 | France . |
| 8417052 | 5/1986 | France . |
| 2624062 | 6/1989 | France . |
| 2217826 | 10/1973 | Germany . |
| 2336733 | 2/1975 | Germany . |
| 2407552 | 8/1975 | Germany . |
| 2817210 | 11/1978 | Germany . |
| 3142829A1 | 5/1983 | Germany . |
| 3412064A1 | 10/1985 | Germany . |
| 1482687 | 8/1977 | United Kingdom . |
| 2226591 | 7/1990 | United Kingdom . |

OTHER PUBLICATIONS

Japanese Utility Model Application Laid Open (Kokai) No. 2-87283 published Jul. 1990.

Japanese Utility Model Application Laid Open (Kokai) No. 57-66936 published Apr. 1982.

Japanese Utility Model Application Laid Open (Kokoku) No. 51-42783 published Oct. 1976.

Japanese Patent Application Laid Open (Kokai) No. 1-229109 (corresponding to U.S. Appl. No. 63,438) published Aug. 1989.

(List continued on next page.)

*Primary Examiner*—Kenneth J. Dorner
*Assistant Examiner*—Joanne Silbermann
*Attorney, Agent, or Firm*—Nixon & Vanderhye

[57] ABSTRACT

An apparatus for mounting an advertisement notice, which comprises an attachment (3) provided between a flexible sheet-like advertisement notice (4) and an advertisement medium (1) for detachably mounting the advertisement notice (4) on the medium (1), and a lashing belt (17) with a buckle, provided between the advertisement notice (4) and the medium (1) for adjusting the strained state of the advertisement notice (4), the attachment (3) being so adapted to slidably receive a swell (125) formed on one end of the advertisement notice (4).

2 Claims, 15 Drawing Sheets

OTHER PUBLICATIONS

Japanese Patent Application Laid Open (Kokai) No. 1-229109 (corres. U.S. Appln. No. 63,438) published Sep. 1989.

Japanese Utility Model Application Laid Open (Kokai) No. 55-29454 published Feb. 1980.

Japanese Patent Application Laid Open (Kokai) No. 61-21367 published Feb. 1986.

Japanese Utility Model Application Laid Open (Kokai) No. 64-38672 published Mar. 1989.

International Search Report.

European Search Report.

APPARATUS FOR MOUNTING ADVERTISEMENT NOTICE

This application is a division of U.S. patent application Ser. No. 07/768,221, filed Oct. 15, 1991, now U.S. Pat. No. 5,373,653.

FIELD OF THE INVENTION

The present invention relates to advertisement notice mounting apparatus for mounting a sheet-like advertisement notice on a medium for an advertisement.

BACKGROUND ART

In order to fix a sheet-like advertisement notice securely to a medium for an advertisement, it has been a conventional practice to place an advertisement notice directly on the medium by applying an adhesive such as a paste to the advertisement notice and sticking the same to the medium, or otherwise, indirectly by sticking the advertisement notice to a panel and mounting the panel to the medium.

However, there is such a disadvantage in the work for applying the adhesive to the advertisement notice and sticking the same to the panel or the medium or peeling the advertisement notice off the panel or the medium that much labor and time is required and cost increases.

The present invention has been made in view of the above problem. It is an object to provide an advertisement notice mounting apparatus which does away with the above-mentioned work of sticking and peeling and which is capable of securely fixing an advertisement notice to a medium for an advertisement.

SUMMARY OF THE INVENTION

According to the present invention, the above object is achieved by an apparatus for mounting advertisement notice, the apparatus comprising mounting means provided between a flexible sheet-like advertisement notice and an advertisement medium for detachably mounting the advertisement notice to the medium, and mounting adjusting means provided between the advertisement notice and the medium for adjusting a stretch state of the advertisement notice.

The advertisement notice mounting apparatus according to the present invention is easily capable of mounting an advertisement notice to an advertisement medium, not only on a truck, but also on places where it is difficult to put up an advertisement, such as on the wall of a station yard, a movie theater, or a building, additionally capable of relatively easily performing maintenance of advertisement notice, capable of reducing the work time and cost, and further capable of securely fixing the advertisement notice to the medium.

This invention will be described with reference to preferred embodiments shown in the accompanying drawings.

However, this invention is not restricted to those embodiments at all.

THE BEST MODE FOR CARRYING OUT THE INVENTION

Figure 1:
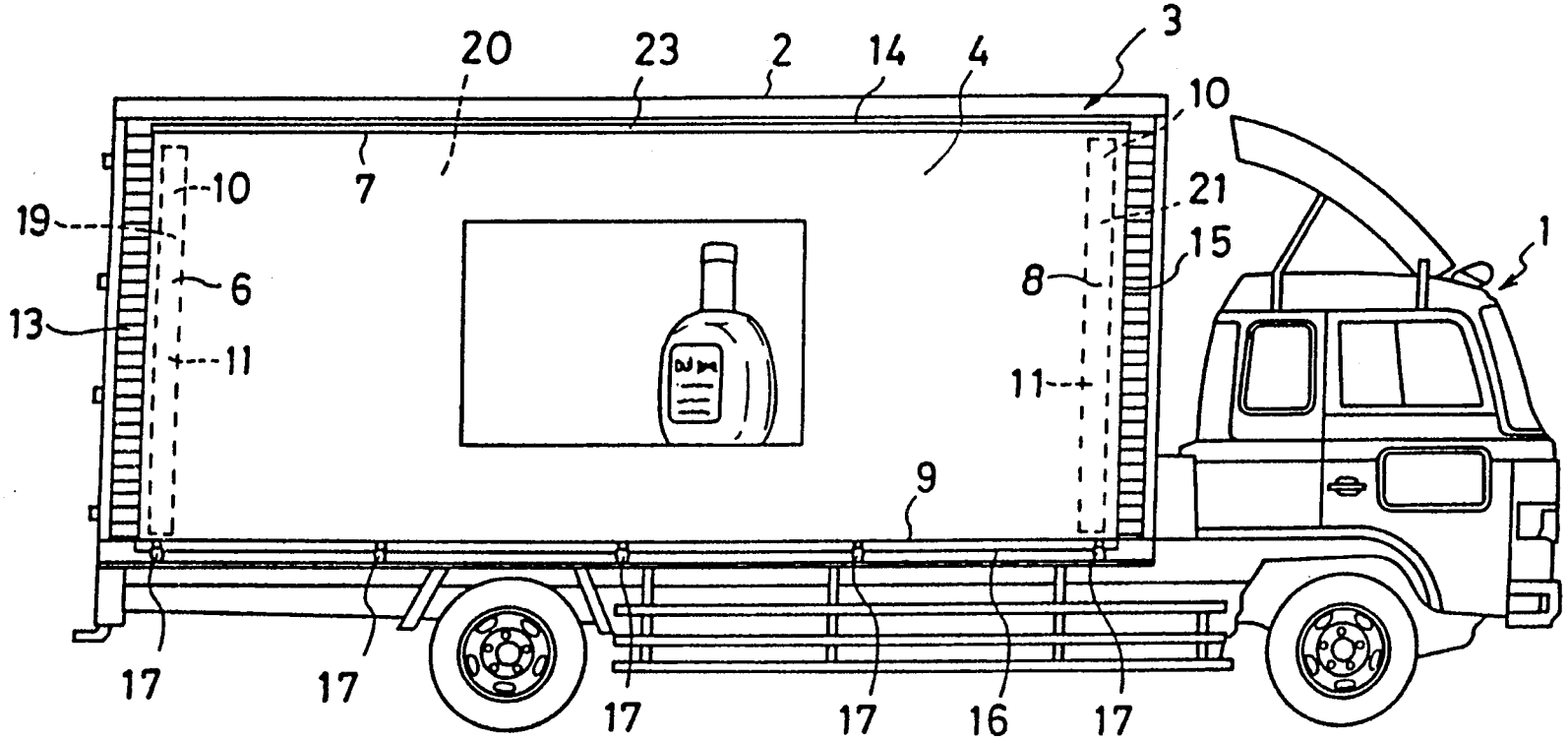
FIG. 1 is a view showing the whole arrangement of a first embodiment of the advertisement notice mounting apparatus of this invention applied to a truck of a panel van type.
Figure 2:
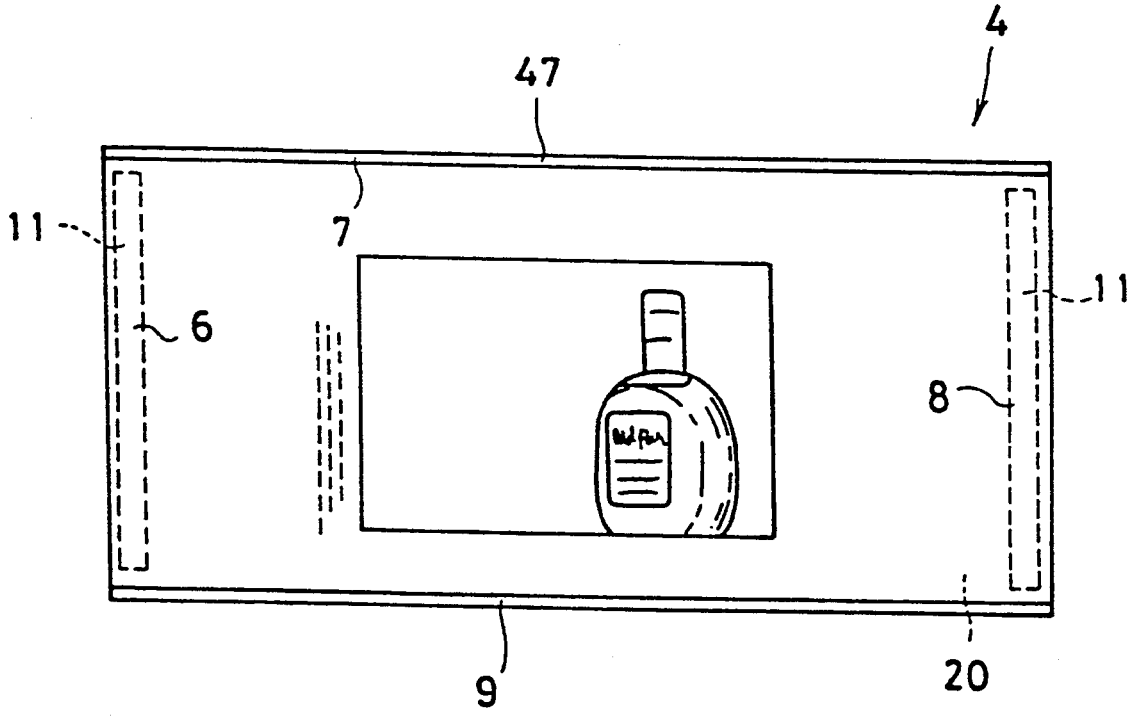
FIG. 2 is a schematic front view of the whole advertisement notice to be mounted on an advertisement medium by an advertisement notice mounting apparatus according to this invention.

In FIGS. 1 to 5, a poster 4 as an example of the advertisement notice is detachably mounted by an advertisement notice mounting apparatus 3 on a side wall 2 of a truck 1 of a panel van type as an example of an advertisement medium.

The advertisement notice mounting apparatus 3 comprises an elongated frame 23 having an L-like or J-like configuration in cross section and provided between a periphery 7 of the poster 4 made of a flexible material and a part 14 of side wall 2 which corresponds to the position of the periphery 7, elongated thin plates 19 and 21 provided between opposing peripheries 6 and 8 of the poster 4 and parts 13 and 15 of the side wall 2 which correspond to the positions of the peripheries 6 and 8, respectively, and a mounting adjuster 17 provided between a periphery 9 of the poster 4 and a cross sill at the part 16 of the side wall 2 which corresponds to the position of the periphery 9.

In this embodiment, one-sided faster members 11 of magic type fasteners, that is, velvet type fasteners are attached to the reverse side 20 of the poster 4 along the opposite peripheries 6 and 8 of the poster 4.

For the material of the poster 4, a vinyl film, particularly a soft vinyl film is preferably used. However, a material similar to the above material, such as canvas, vinyl sheet, tarpaulin, or rubber sheet may be used.

Needless to say, it is possible to use any material which can perform the function of a poster and has a strength which allows the fastener members 11 to be attached along the peripheral edges of the poster 4.

Figure 3:
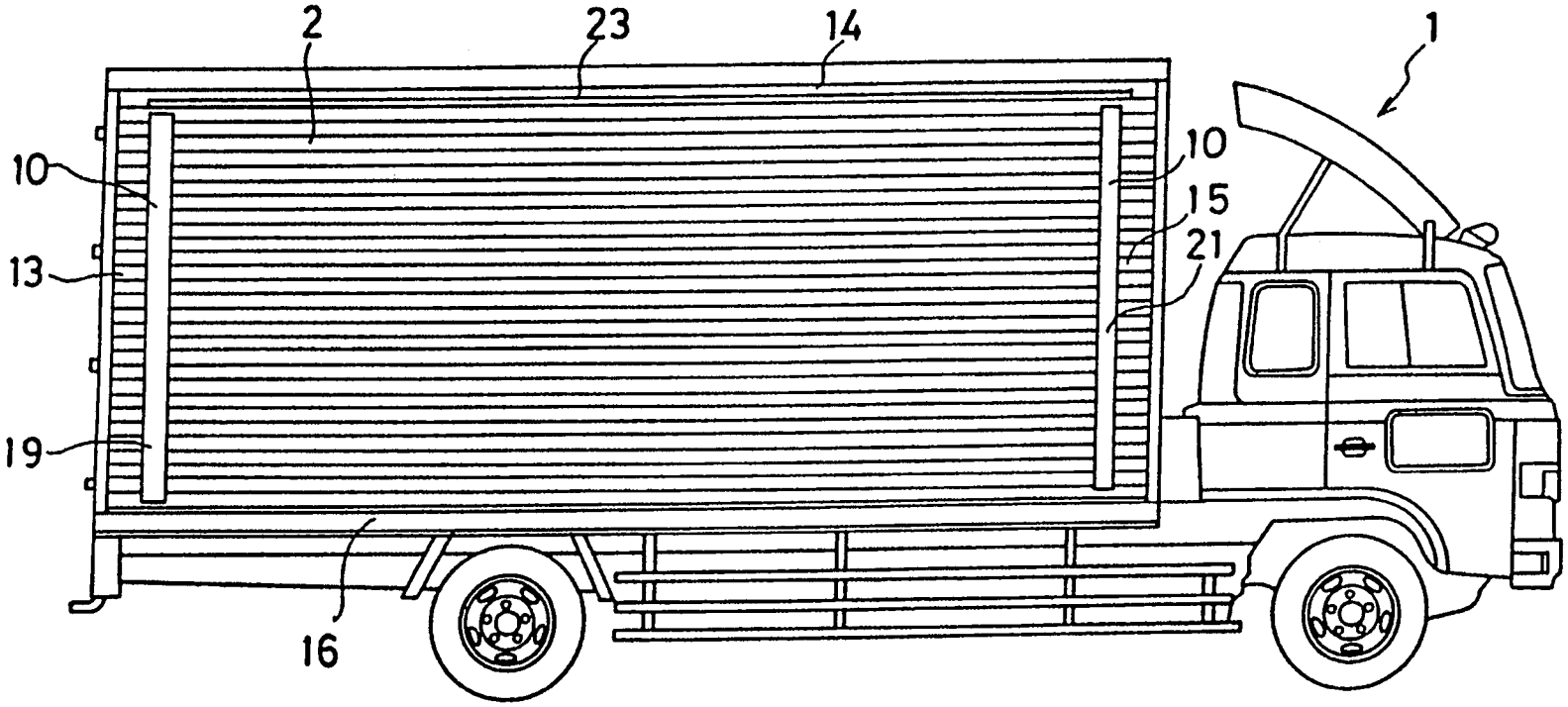
FIG. 3 is a schematic view of the whole medium on which an advertisement notice is mounted by the advertisement notice mounting apparatus according to this invention.

As shown in FIGS. 1 and 3, in this embodiment, the other-sided fastener members 10 of the velvet type fasteners are respectively attached to the thin plates 19 and 21 provided at the peripheries 13 and 15 of the side wall 2 to fix the poster 4 to the side wall 2 in cooperation with the one-sided velvet fastener members 11 which are attached to the peripheries 6 and 8 of the poster 4, respectively.

As the fastener members 10 engage the fastener members 11 of the opposing peripheries 6 and 8 of the poster 4, they connect and fix the poster 4 to the side wall 2.

A frame 29 is mounted on and along the periphery 9 of the poster 4. The periphery 9 of the poster 4 is turned up, superimposed on the reverse side 20 of the poster 4 and fixed by means of, for example, sewing **4*a* and the like, and the frame 29 is inserted into a space 4*b* formed at the periphery 9 of the poster 4 which is turned up and superimposed. The frame 29 has a slit 29*a*, and when the frame 29 is inserted into the space 4*b* at the periphery 9 of the poster 4, the frame 29 is positioned so that the slit 29*a* coincides in position with the opening 4*c* formed at the periphery 9**.

The mounting adjuster 17 for adjusting the strained state of the poster 4 is connected at one end thereof to the opening **4*c* and the slit 29*a*, and at the other end thereof to the cross sill at the periphery 16 of the side wall 2**.

The mounting adjuster 17 comprises a hook 79 formed so as to hook the cross sill at the periphery 16, a belt 80 fixedly connected at one end thereof to a hook 78 formed so as to hook in the opening **4*c* and the slit 29*a* and at the other end thereof to the hook 79, and a length adjuster 81 provided on the middle portion of the belt 80 to adjust length of the belt 80**.

Therefore, by adjusting the length adjuster 81 of the belt 80 of the mounting adjuster 17, the strained state of the poster 4 that has been mounted can be set as desired.

For the material of the belt 80, a relatively tough cloth, for example, of nylon is preferably used.

As the mounting adjuster 17, a lashing belt with a buckle having a so-called ratchet function may be used.

Figure 5:
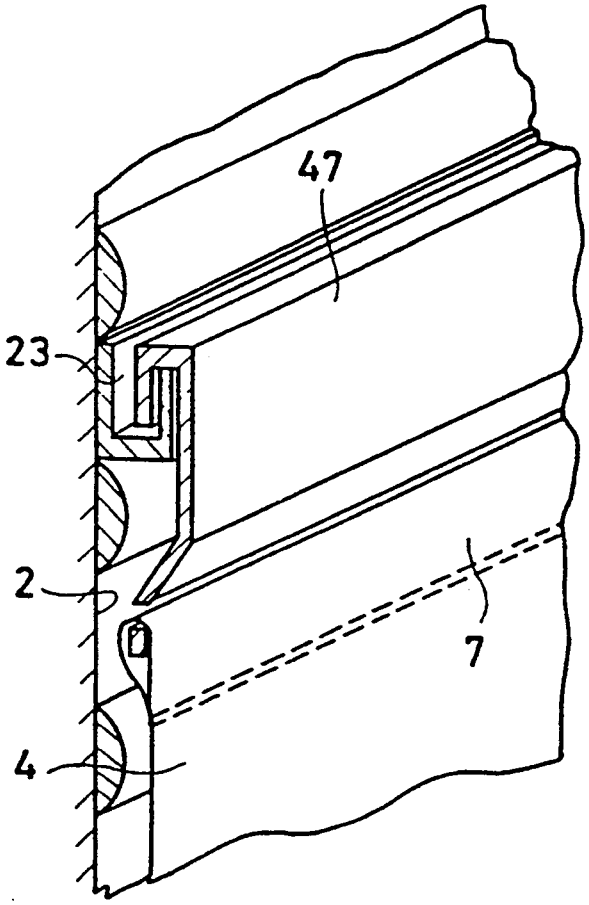
FIG. 5 is a perspective view showing the relation of an advertisement notice to the first embodiment of the advertisement notice mounting apparatus of this invention.

As shown in FIGS. 1 and 5, the poster 4 is fitted along the periphery 7 thereof with an elongated frame 47 having an L-like or J-like configuration in cross section. The frame 47 is connected to the rail 23 in the manner shown in FIG. 5.

The process for equipping the advertisement notice mounting apparatus 3 to the side wall 2 of the truck 1 will be described.

As shown in FIG. 3, a rail 23 is previously fitted fixedly to the periphery 14 of the side wall 2 by means of welding or the like. Then, one-sided velvet fastener members 10 are previously fitted fixedly by means of an adhesive or the like to the thin plates 19 and 21 provided respectively to the peripheries 13 and 15 of the side wall 2.

Figure 6:
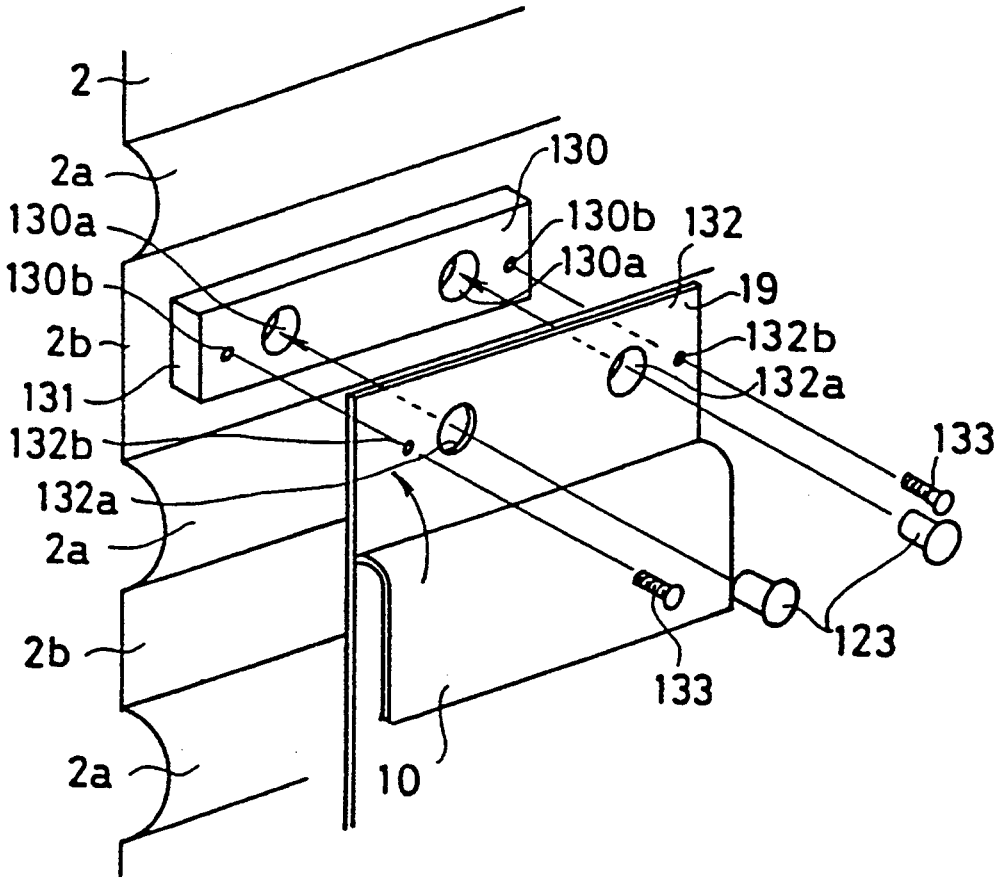
FIG. 6 is a perspective view showing the relation of the medium to the first embodiment of the advertisement notice mounting apparatus of this invention.

More specifically, as shown in FIG. 6, as an example, a block member 130 having a thickness corresponding to the height of ribs **2*a* is disposed in each groove 2*b* between the ribs 2*a* of the side wall 2, and rivets 123, for example, are driven into holes 130*a* to thereby fix the member 130 to the side wall 2. On top of the member 130, a strip-like thin plate 19 is arranged, and then screws 133 are screwed into holes 132*b* and 130*b* to thereby fix the thin plate 19 to the side wall 2. A fastener member 10 is attached to a surface 132 of the thin plate 19**.

Under the above-mentioned state, the elongated frame 47 attached to the poster 4 is hooked on the rail 23 fixed to the side wall 2, as shown in FIG. 5. Next, the lower periphery 9 of the poster 4 is pulled while keeping the poster 4 in the uniformly trained state, the poster 4 is stretched by an elastic force of the poster 4, and thus, the mounted state of the poster 4 to the side wall 2 of the truck 1 is adjusted by the mounting adjuster 17.

Then, the poster 4 is fixed to the side wall 2 by connecting the one-sided velvet fastener members 11 on the poster 4 to the corresponding opposite-sided fastener members 10 on the side wall 2, that is to say, by engagement of those fastener members.

When the poster 4 is small, fixing the poster 4 to the side wall 2 by engagement of the fastener members 10 and 11 may be omitted.

Under this state, the poster 4 is constantly strained by the elastic force of the poster 4 itself, so that the poster 4 is subjected to a strong tension. By such a strong tension, a slack in the poster 4 can be removed.

In other words, the mounted state of the poster 4 can also be adjusted automatically by the elastic force of the poster 4 itself.

In this embodiment, for the member to be connected to the rail 23, the elongated frame 47 having a substantially J-like configuration in cross section is so adopted that the frame 47 can be hooked to the rail 23 shown in FIG. 5. Instead, a frame 48 as shown in FIG. 7 or a frame 49 as shown in FIG. 8 may be used.

Figure 7:
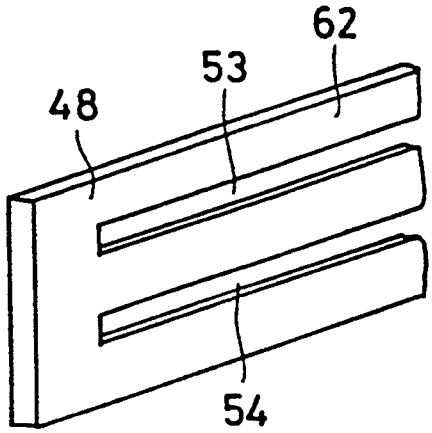
FIGS. 7 and 8 are fragmentary perspective views showing the construction of essential parts in other embodiments of the advertisement notice mounting apparatus of this invention.
Figure 9:
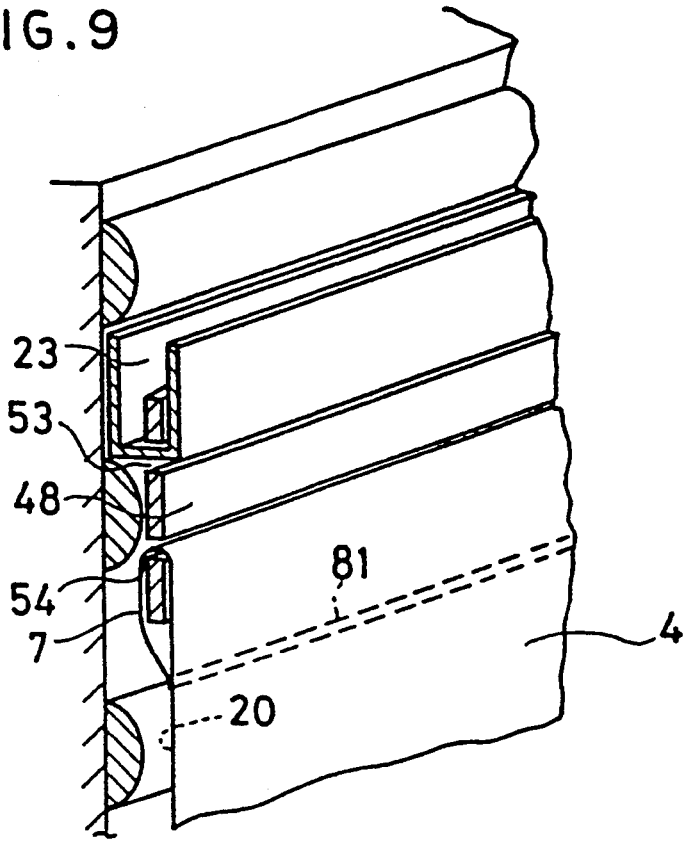
FIG. 9 is a perspective view showing the relation of an advertisement notice to the other embodiment of the advertisement notice mounting apparatus of this invention.

FIG. 9 shows the mounted state of the poster 4 to the side wall 2 when the frame 48 as shown in FIG. 7 is used.

The frame 48 has two slits 53 and 54 as shown in FIG. 7. As shown in FIG. 9, the periphery 7 of the poster 4 is inserted into the slit 54. The inserted periphery 7 is turned and superimposed on the reverse side 20 of the poster 4, and fixed by means of sewing 81 or the like. The frame 48 fitted with the poster 4 is inserted into the rail 23, as shown in FIG. 9, in order to cause the frame 48 to engage the rail 23. When the frame 48 is made to engage the rail 23, the poster 4 and the frame 48 combined to each other are once held horizontally, and are moved to a position where the slit 53 aligns with a front wall 63 of the rail 23 shown in FIG. 10. From this position, the combined poster 4 and frame 48 is moved vertically downward as indicated by arrow 58, until the slit 53 receives the rail front wall 63. Then, by turning the combined poster 4 and frame 48 in the direction indicated by an arrow 59, the engagement of the frame 48 with the rail 23 is completed. For this motion to be accomplished, the width 56 of a bottom wall 61 of the fall 23, the width 57 of a part 62 of the frame 48 and the height 60 of the front wall 63 of the rail 23, and so on are selected.

Figure 8:
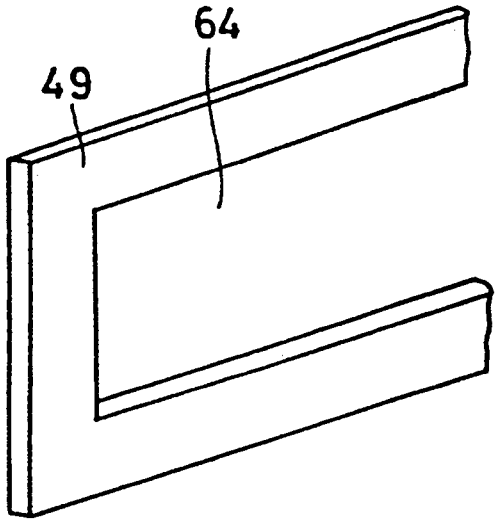
Figure 10:
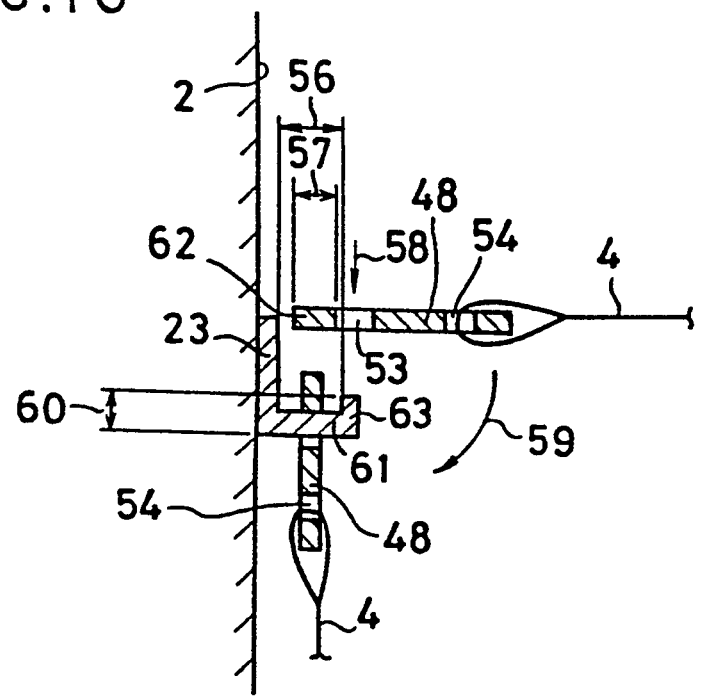
FIGS. 10 to 14 are explanatory views of the mounted states in the advertisement notice mounting apparatus according to this invention.

In mounting the poster 4 to the side wall 2 when a frame 49 as shown in FIG. 8 is used, the above-mentioned operation indicated in FIG. 10 need not be performed because the frame 49 has an opening 64 instead of the slits 53 and 54, the opening 64 having an area greater than the opening area of the slits 53 and 54.

Figure 11:
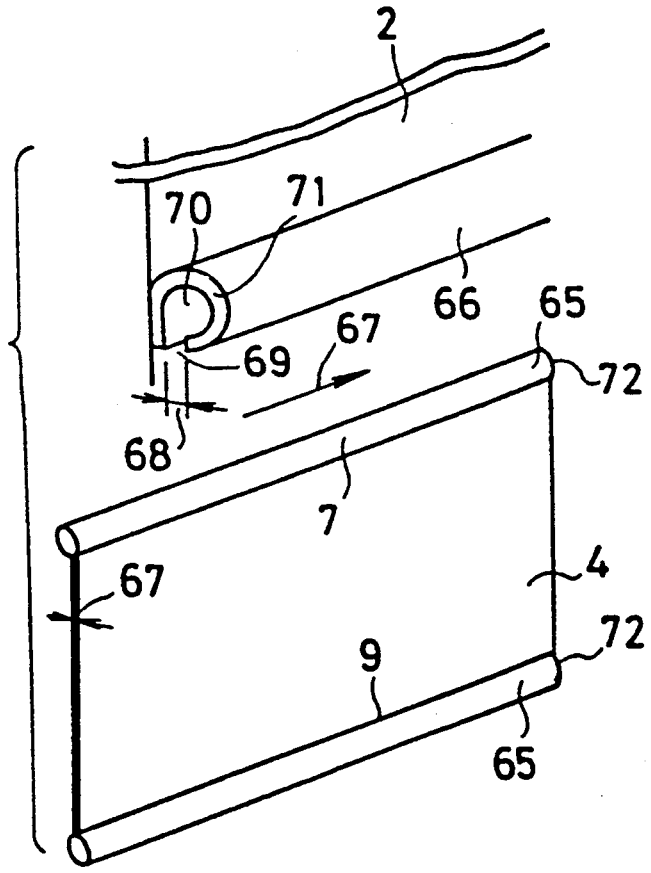

Instead of the fall 23 used in the above-mentioned embodiment, a rail 66 having a round cross section as shown in FIG. 11 may be used. The rail 66 has a slit 69 which has a width 68 greater than the thickness 67 of the poster 4. On the other hand, each of the peripheries 7 and 9 of the poster 4 is fitted with a rod-shaped frame 65 which has some rigidity and can be inserted into an internal space 70 of the rail 66.

When the poster 4 arranged as described is mounted to the side wall 2, one end 72 of the frame 65 is inserted into the internal space 70 of the rail 66 from, for example, the opening end 71 of the rail 66, and the frame 65 is moved in the direction indicated by an arrow 67. At this time, the poster 4 is passed through the slit 69 of the rail 66.

Figure 12:
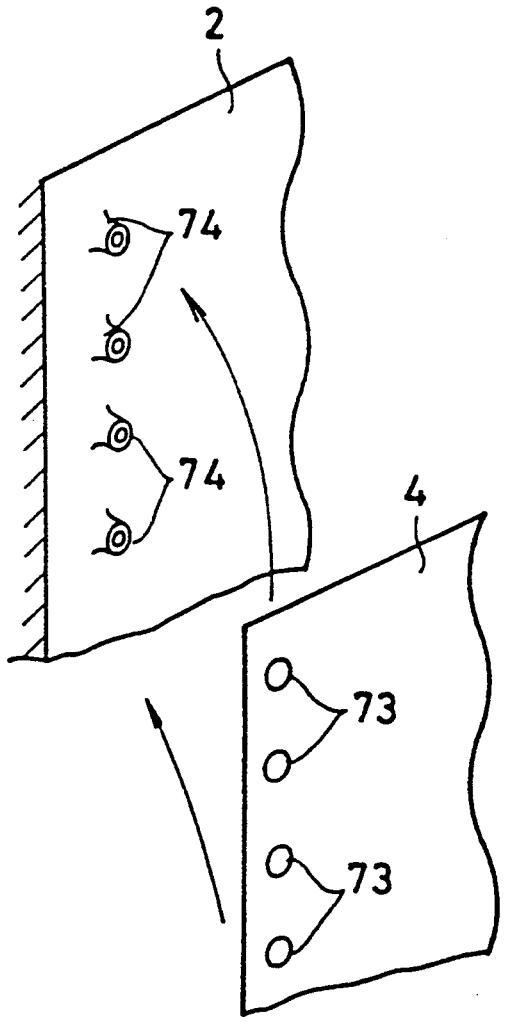

Instead of the velvet type fasteners used for mounting the poster 4 to the side wall 2 in the above-mentioned embodiment, snap type fasteners as shown in FIG. 12 may be used. The snap type fastener comprises a fastener member 74 fixedly attached to the side wall 2 and a fastener member 73 fixedly attached to the poster 4. Those fastener members 73 and 74 can be fixed to each other by fitting.

Figure 13:
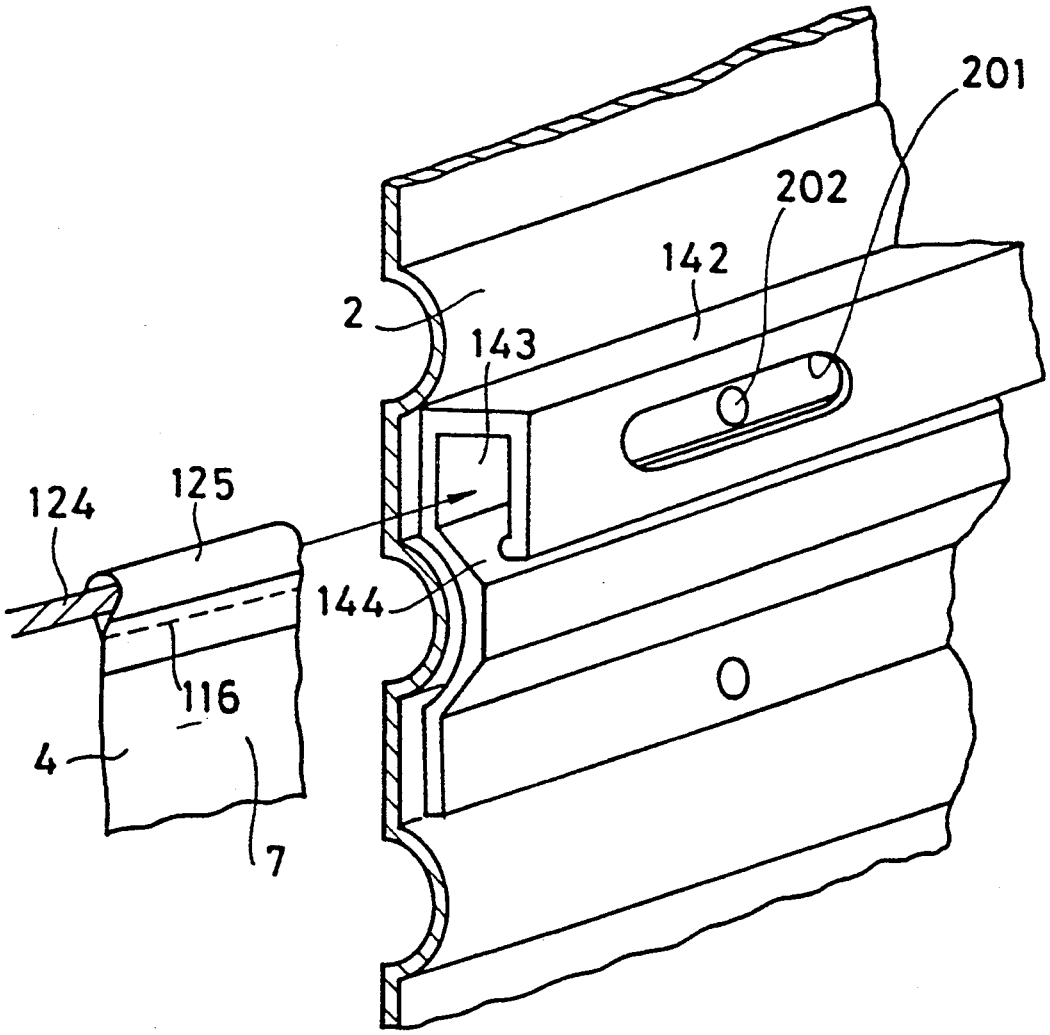

In an embodiment shown in FIG. 13, instead of the relatively rigid rod-shaped frame 65 used in the above-mentioned embodiment, a flexible rod-shaped member, for example, a relatively thick rope 124 made of a fabric material such as nylon is used. To be more specific, preferably, a flexible rod-shaped member, for example, a relatively thick rope 124 made of a fabric material such as nylon is wrapped in each of the peripheries 7 and 9 at the top and the bottom of the poster 4, and fixed by fixing means 116 such as sewing or the like, and swollen ends 125 are thereby formed at the top and bottom sides.

The reason why the flexible rod-shaped frames, for example, of ropes 124 instead of the relatively rigid rod-shaped frames 65 is to make the poster 4, including equivalent parts to be described later, foldable and convenient for carrying or storing purposes.

As described above, the advertisement notice mounting apparatus 3 according to this embodiment comprises mounting mechanisms at the top, left and right for mounting the poster 4 to the side wall 2 of the truck 1, and the mounting adjuster 17 at the bottom.

Instead of the rail 66 with a round cross section shown in FIG. 11, a rail 142 having a slit space 144 for accepting the thickness of the poster 4 and a space 143 for receiving the swollen end 125 may be used, as shown in FIG. 13.

The rail 142 is formed as a continuous piece as shown in FIG. 13, but the rail 142 is not required to be necessarily made continuous. Substantial continuity can be imparted to the rail by continuously arranging individual members formed with the same cross section.

Figure 14:
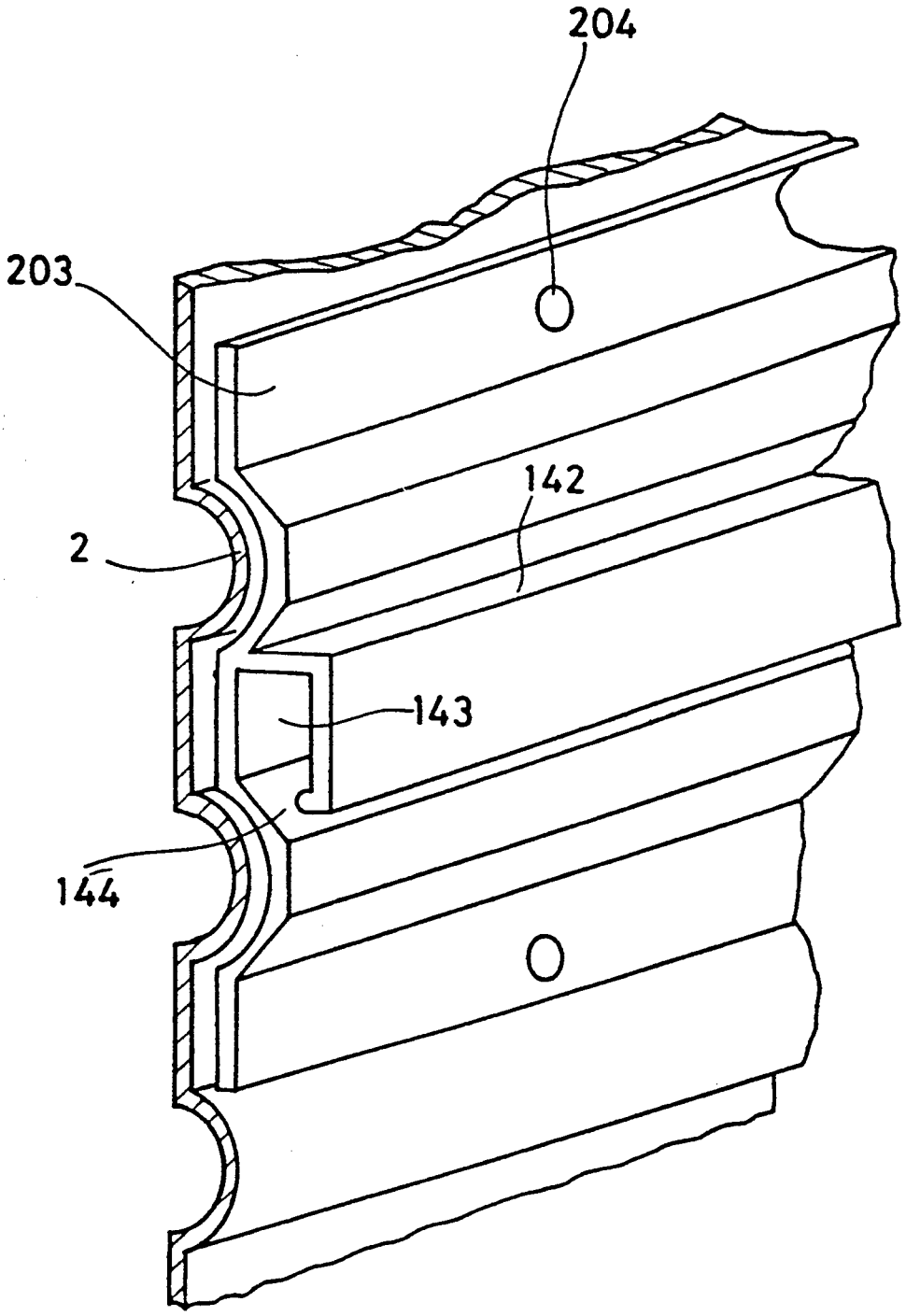

In the embodiment shown in FIG. 13, a slot 201 is provided in the fall 142, a rivet 202 is driven into the rail 142 and the side wall 2 through the slot 201 to thereby fix the rail 142 to the side wall 2, instead, an upward extension 203 may be provided integrally on the upper end of the rail 142 as shown in FIG. 14, a rivet 204 may be driven into the extension 203 and the side wall 2, and thereby fix the extension 203 and hence the rail 142 to the side wall 2. This method facilitate the driving in of the rivet 204.

From the above embodiments, it will be understood that various changes and modifications may be made in the advertisement notice mounting apparatus according to this invention.

Figure 15:
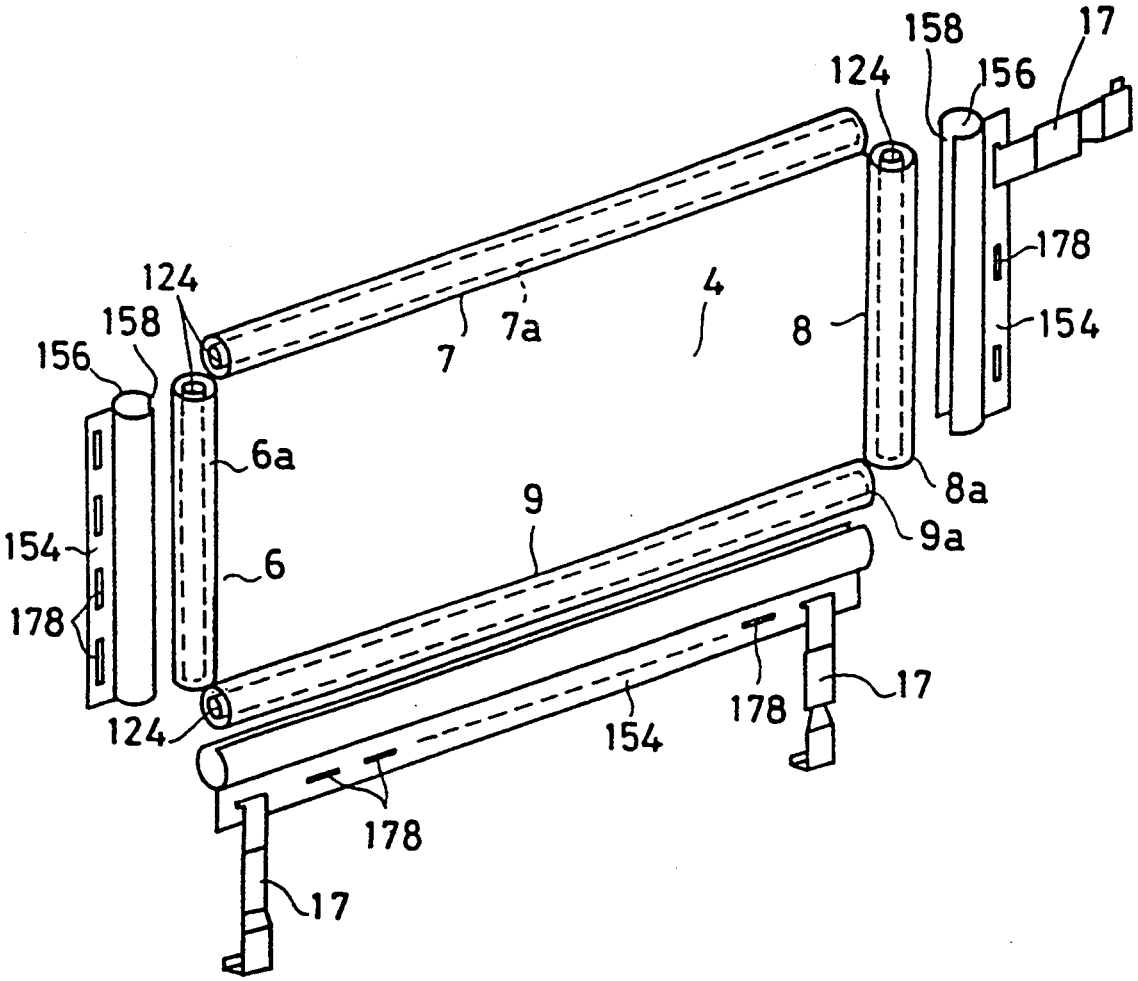
FIG. 15 is an explanatory view of a further embodiment of the advertisement notice mounting apparatus according to this invention.

For example, a poster 4 arranged as shown in FIG. 15 may be used.

Figure 16:
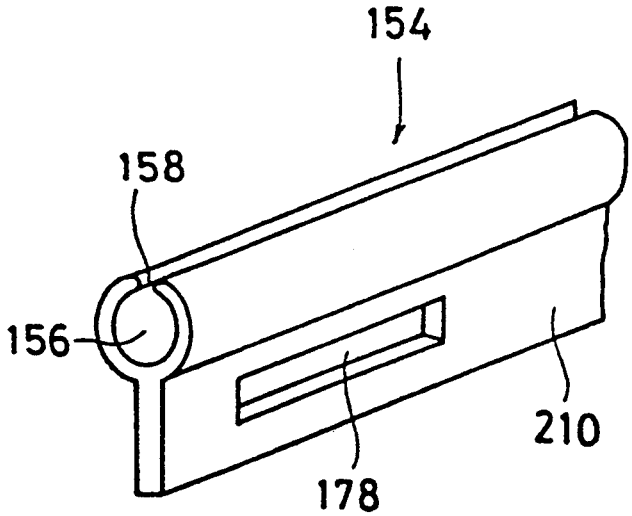
FIG. 16 is an explanatory view of a component of the advertisement notice mounting apparatus according to this invention.

In the poster 4 shown in FIG. 15, instead of the one-side members 11 of the magic type fasteners provided at the right and left peripheries 6 and 8 and the frames 29 and 47 provided at the upper and lower peripheries 7 and 9, flexible rod-shaped members, for example, relatively thick ropes 124 made of a fabric material such as nylon and the like, used in the embodiment shown in FIG. 13, are wrapped by the peripheries 6, 7, 8 and 9, and thereby, swollen ends 6*a*, 7*a*, 8*a*, and 9*a* are formed. Attachments 154 shown in FIG. 16 are used in the manner as shown in FIG. 15 to accommodate the swollen ends 6*a*, 7*a*, 8*a*, and 9*a* in this embodiment and to thereby connect the poster to the side wall 2.

The attachment 154 has a slit 158 which has a width corresponding to the thickness of the poster 4, and a space 156 for receiving and engaging any of the swollen ends 6*a*, 8*a*, and 9*a* at the right, left, and bottom of the poster 4.

Figure 4:
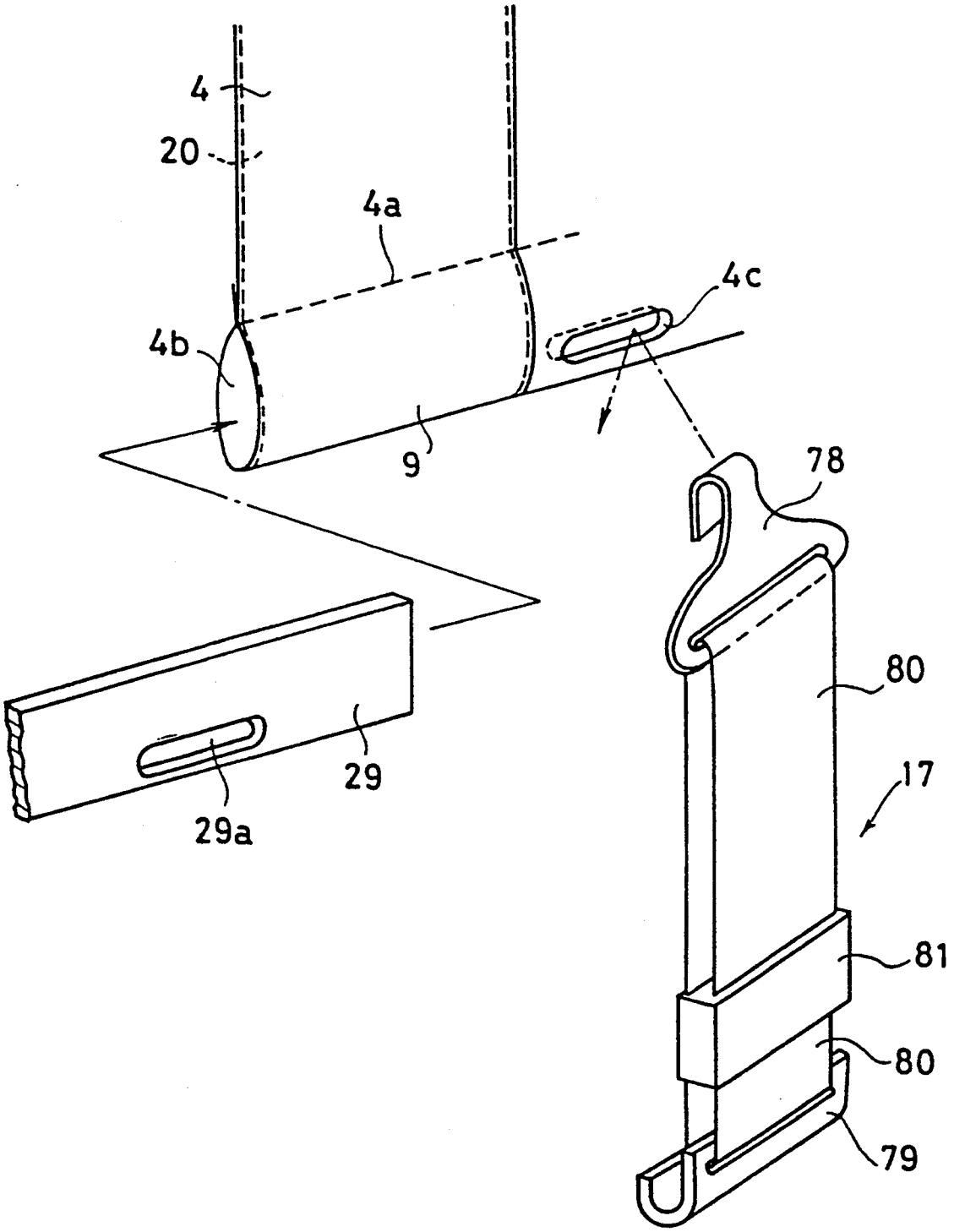
FIG. 4 is an explanatory view showing a connecting state of the first embodiment of the advertisement notice mounting apparatus of this invention.

Each attachment 154 has a slit 178 for connection with the mounting adjuster 17 shown in FIG. 4.

Therefore, as in the foregoing embodiments, the strained state of the poster 4 can be adjusted under the state in which the poster 4 is connected to the side wall 2.

Figure 17:
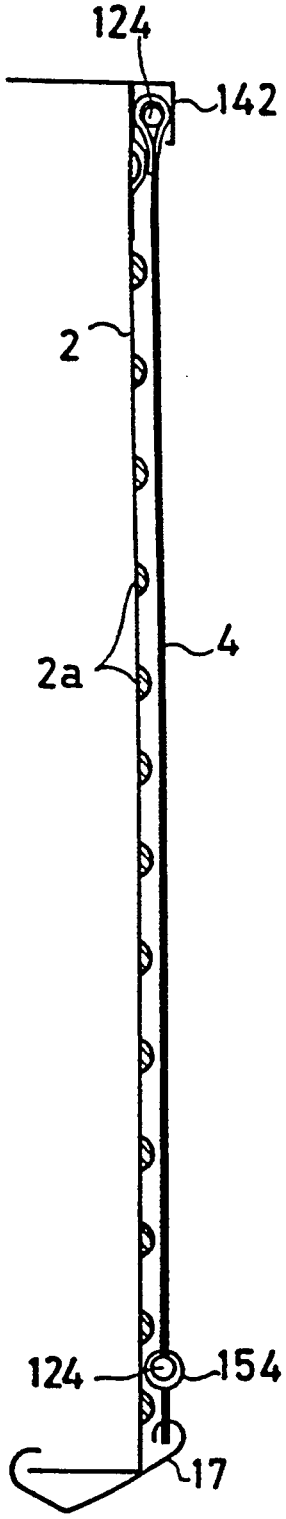
FIG. 17 is a side sectional view of the further embodiment of the advertisement notice mounting apparatus according to this invention.

FIG. 17 shows a cross section seen from the side of the poster 4 mounted on the side wall 2.

Figure 18:
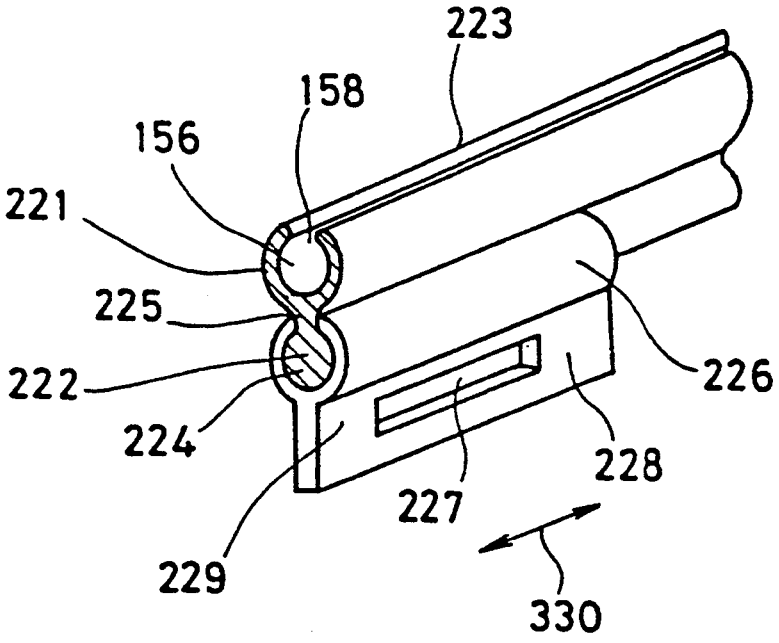
FIG. 18 shows another example of the component of the advertisement notice mounting apparatus according to this invention.

The attachment 154 shown in FIG. 16 has a plurality of slits 178 on the plate-like portion 210 thereof in the extending direction of the plate-like portion 210, the slits 178 being used for connection with the mounting adjuster 17, instead, as shown in FIG. 18, arrangement may be such that an attachment 223 is formed with a cylinder 221 having a slit 158 and a swell 222 formed integrally with the cylinder 221, that an auxiliary attachment 229 which comprises a cylinder 226 and a plate-like part 228, is provided, the cylinder 226 having a space 224 for receiving the swell 222 in a freely slidable manner and a slit 225 communicating with the space 224 and the plate-like part 228 having a slit 227 and formed integrally with the cylinder 226, that one end of the mounting adjuster 17 is engaged into the slit 227, and that the mounting adjuster 17 is connected with the attachment 223 through the attachment 223. Since the auxiliary attachment 229 is capable of freely sliding in the direction of arrow 330 with respect to the attachment 223, the mounting adjuster 17 can be set at any position in the direction of arrow 330 even if many slits 178 as shown in FIG. 15 are not provided. It is to be noted that the auxiliary attachment 229 can be connected with the attachment 223 by inserting the swell 222 laterally into the space 224.

I claim:

1. A mounting apparatus for mounting an advertisement notice having an enlargement formed along an end margin thereof, and another margin which is turned and secured to said notice to define a space opening at one end of said another margin of said notice, comprising:

mounting means for detachably mounting the advertisement notice to an advertisement medium; and mounting adjusting means for connecting between said mounting means and the advertisement medium for maintaining the advertisement notice under tension, said mounting means comprising an elongated member having a slit opening in a direction toward the advertising notice and a space within said member in communication with the slit, said elongated member being adapted to slidably receive in said space and endwise thereof said enlargement of the notice such that the end margin of the notice passes longitudinally along and through said slit for retention in the space within the elongated member and against passage thereof through said slit, said mounting means further comprising a frame having a slit, said frame being adapted to be slidably inserted into said space of the another margin of the notice and positioned such that the slit of the frame registers with an opening formed adjacent said one end of the advertisement notice margin when the frame is inserted into the space of the advertisement notice, said mounting adjusting means comprising a first hook for connection to said mounting means, a second hook for connection to the advertisement medium and a belt extending between the first and second hooks and having means for setting selected distances between the first and second hooks.

2. A mounting apparatus for mounting an advertisement notice according to claim 1, wherein said elongated member has a generally J-like cross-section.

* * * * *